US008905398B2

(12) United States Patent
Kotaka

(10) Patent No.: US 8,905,398 B2
(45) Date of Patent: Dec. 9, 2014

(54) MEDIUM FEEDING DEVICE, SCANNER AND RECORDING APPARATUS

(75) Inventor: Toshikazu Kotaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/469,205

(22) Filed: May 11, 2012

(65) Prior Publication Data

US 2012/0292846 A1 Nov. 22, 2012

(30) Foreign Application Priority Data

May 16, 2011 (JP) ..... 2011-109081

(51) Int. Cl.
*B65H 3/52* (2006.01)
*B65H 3/56* (2006.01)

(52) U.S. Cl.
CPC ..... *B65H 3/5223* (2013.01); *B65H 3/56* (2013.01); *B65H 2801/06* (2013.01)
USPC ..... 271/121

(58) Field of Classification Search
USPC ..... 271/121, 122, 124, 104, 137, 114, 117, 271/118
See application file for complete search history.

(56) References Cited

U.S. PATENT DOCUMENTS

| | | | | |
|---|---|---|---|---|
| 4,330,115 | A * | 5/1982 | Mouri et al. | 271/124 |
| 5,094,440 | A * | 3/1992 | Matsuo et al. | 271/121 |
| 5,934,665 | A * | 8/1999 | Kasahara | 271/122 |
| 2009/0310176 | A1 * | 12/2009 | Ito | 358/1.15 |
| 2010/0020370 | A1 | 1/2010 | Ishikawa | |
| 2010/0237555 | A1 * | 9/2010 | Hsiao | 271/121 |

FOREIGN PATENT DOCUMENTS

| | | |
|---|---|---|
| JP | 62-264137 | * 11/1987 |
| JP | 05-077959 | 3/1993 |
| JP | 5-254684 | * 10/1993 |
| JP | 11-049395 | 2/1999 |
| JP | 2010-028546 | 2/2010 |

* cited by examiner

*Primary Examiner* — Thomas Morrison
(74) *Attorney, Agent, or Firm* — Workman Nydegger

(57) ABSTRACT

A medium feeding device includes a medium feeding unit that feeds a medium placed in a set position, and a friction separation member that is disposed downstream of the medium feeding unit and is configured to come into contact with the underside of the medium, the friction separation member being deformable, and feed path restriction members that are arranged such that the friction separation member is located between the feed path restriction members, the contact portion of the feed path restriction member which comes into contact with the topside of the medium being located at a position lower than the upper surface of the friction separation member.

7 Claims, 8 Drawing Sheets

MEDIUM FEEDING DEVICE, SCANNER AND RECORDING APPARATUS

BACKGROUND

1. Technical Field

The present invention relates to a medium feeding device that feeds a medium, a scanner having the same and a recording apparatus having the same.

2. Related Art

Ink jet printers are an example of recording apparatuses. Recently, so-called multifunction machines which incorporate scan function in addition to print function have gained popularity as ink jet printers. Multifunction machines are capable of performing both reading of a document and recording on a sheet of paper, which provide convenience to a user and save the installation space.

Scanners sometimes include an automatic feeder (also known as auto document feeder (ADF)) and are configured to perform automatic feeding and reading of a plurality of documents. For example, JP-A-2010-28546 discloses a configuration of document automatic feeder in which a document is fed out from a document tray, turned to the opposite direction around a roller, transported to a reading position, and then output to an output tray.

In such automatic document feeders, and also in sheet feeding units of ink jet printers, it is important to separate a medium to be fed and the subsequent media with certainty so as to prevent the subsequent media from being fed along with the medium to be fed.

In order to prevent such double-feed, a friction pad or projection (such as claw and hook) is typically used as a separation unit, for example as described in JP-A-5-77959 and JP-A-11-49395. Moreover, JP-A-2010-28546 and JP-A-5-77959 discloses the use of two separation units, an upstream separation unit and a downstream separation unit, with the aim of further improving separation of the media.

Although JP-A-5-77959 and JP-A-11-49395 disclose a sheet feeder that is provided with two separation units so as to further improve separation of the sheets, the sheet feeder has a disadvantage in that the sheets may be double-fed when the leading edge of the sheet is curled. In particular, since the downstream separation unit of the sheet feeder disclosed in JP-A-5-77959 and JP-A-11-49395 is formed by a projection, it is highly possible that separation of the sheets is not performed when the leading edge of the sheet is curled in a direction in which the leading edge does not interfere with the projection.

SUMMARY

An advantage of some aspects of the invention is that a medium feeding device capable of preventing double-feed with certainty even if the leading edge of a medium is curled is provided.

According to an aspect of the invention, a medium feeding device in a first embodiment includes a medium feeding unit that feeds a medium placed in a set position, and a first separation unit that is disposed downstream of the medium feeding unit and separates the medium to be fed and the subsequent media, and a second separation unit that is disposed downstream of the first separation unit and separates the medium to be fed and the subsequent media, wherein the second separation unit is composed of a friction separation member and a feed path restriction member that cooperates with the friction separation member to close a feed path of the medium as seen in a side view of the feed path.

According to the first embodiment, a plurality of separation units that separate the media are provided as the upstream first separation unit and the downstream second separation unit. Further, the downstream second separation unit is composed of the friction separation member and the feed path restriction member that cooperates with the friction separation member to close the feed path of the medium as seen in the side view of the feed path. Accordingly, the feed path at a position of the second separation unit seems to be closed as seen in the side view of the feed path. It should be noted that the term "closed" does not mean a state where the feed path is completely closed to block the feeding of the medium to be fed, but means "a state where the feed path seems to be closed as seen in the side view of the feed path".

Consequently, the leading edge of the medium is ensured contact with the friction separation member even if the leading edge of the document is curled, thereby preventing double-feed of the media with certainty. Although the feed path at the position of the second separation unit seems to be closed as seen in the side view of the feed path, the medium to be fed can pass through the second separation unit when the medium or the friction separation member is deformed.

In a second embodiment of the invention, the medium feeding device of the first embodiment may have a configuration in which the friction separation member is positioned such that the medium to be fed is in close contact with the friction separation member when a tension is applied to the medium by pulling the medium from a position downstream of the second separation unit.

According to the second embodiment, the friction separation member is positioned such that the medium to be fed is in close contact with the friction separation member when a tension is applied to the medium by pulling the medium from a position downstream of the second separation unit. Accordingly, when a tension is applied to the medium by the downstream rollers nipping the leading edge of the medium, the media which are induced to be double-fed are forced to be in close contact with the friction separation member, thereby preventing the subsequent media from being double-fed with the medium to be fed with certainty.

In a third embodiment of the invention, the medium feeding device of the first or second embodiment may include a roller that is disposed downstream of the second separation unit and controls a deformation amount of the friction separation member.

According to the third embodiment, since the roller that controls a deformation amount of the friction separation member is disposed downstream of the second separation unit, the feed path remains to be closed by the friction separation member and the feed path restriction member, thereby maintaining the effect of the second separation unit to prevent double-feed of the media as appropriate.

In a fourth embodiment of the invention, the medium feeding device according to any one of the first to third embodiments may have a configuration in which the friction separation member extends upstream so as to constitute the first separation unit.

According to the fourth embodiment, since the friction separation member extends upstream so as to constitute the first separation unit, the friction separation member is common to the first separation unit and the second separation unit, thereby reducing cost of the medium feeding device.

In a fifth embodiment of the invention, the medium feeding device according to any one of the first to fourth embodiments may have a configuration in which the downstream portion of the friction separation member is formed as a non-supported area that is not supported by the support member that supports the friction separation member, and the feed path is closed by the non-supported area and the feed path restriction members as seen in the side view of the feed path.

According to the fifth embodiment, the downstream portion of the friction separation member is formed as the non-supported area that is not supported by the support member that supports the friction separation member, and the feed path is closed by the non-supported area and the feed path restriction members as seen in the side view of the feed path. Accordingly, the friction separation member is relatively easily flexed when the media passes through the second separation unit, thereby avoiding generation of an excessive load when the media passes through the second separation unit.

In a sixth embodiment of the invention, the medium feeding device the fifth embodiments may have a configuration in which the non-supported area of the friction separation member is supported by an elastic member that is elastically deformable.

According to the sixth embodiment, since the non-supported area of the friction separation member is supported by an elastic member that is elastically deformable, it is possible to maintain the property of the non-supported area to be easily deformable while preventing the non-supported area from being plastically deformed and the separation function is irreversibly deteriorated. Further, it is also possible to prevent the non-supported area of the friction separation member from being excessively flexed, thereby preventing the closed state of the feed path from being easily removed.

In a seventh embodiment of the invention, the medium feeding device according to any one of the first to sixth embodiments may have a configuration in which the feed path restriction member is disposed on each side of the friction separation member in a medium width direction.

According to the seventh embodiment, since the feed path restriction member is disposed on each side of the friction separation member in a medium width direction, the medium feed path is configured to be closed at each side of the friction separation member, thereby further improving the effect of the second separation unit to prevent double-feed of the media.

According to another aspect of the invention, a scanner in an eighth embodiment includes a reading unit that reads a surface of a medium, and the medium feeding device according to any one of the first to seventh embodiments that feeds the medium to a reading position where the media is read by the reading unit. Further, according to another aspect of the invention, a recording apparatus in a ninth embodiment includes a recording unit that performs recording to a medium, and the scanner according to the eighth embodiment that is mounted on the upper portion of the recording unit. According to the eighth and ninth embodiments, in the scanner or the recording apparatus, the same effects as those described in the first to seventh embodiments can be achieved.

Further, the medium feeding device according to the ninth embodiment may includes a medium feeding unit that feeds a medium placed in a set position, a friction separation member that is disposed downstream of the medium feeding unit and is configured to come into contact with the underside of the medium, the friction separation member being deformable, and feed path restriction members that are arranged such that the friction separation member is located between the feed path restriction members, the contact portion of the feed path restriction members which comes into contact with the topside of the medium being located at a position lower than the upper surface of the friction separation member.

In a tenth embodiment of the invention, the medium feeding device according to the ninth embodiment may include a separation roller that is disposed upstream of the friction separation member and is configured to come into contact with the topside of the medium.

In an eleventh embodiment of the invention, the medium feeding device according to the tenth embodiment may include a support member that supports the friction separation member, wherein the downstream end of the friction separation member extends from the support member.

In a twelfth embodiment of the invention, the medium feeding device according to the eleventh embodiment may have a configuration in which the support member is movable toward or away from the separation roller and is biased to the separation roller. The medium feeding device according to the ninth to twelfth embodiments can be applied to a scanner or a recording apparatus having the scanner.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described below, although the invention is not limited thereto. In the following description of the embodiment of the invention, a variety of modifications can be made within the scope of the invention as defined by the claims and such modifications are contemplated as within the scope of the invention.

Figure 1:
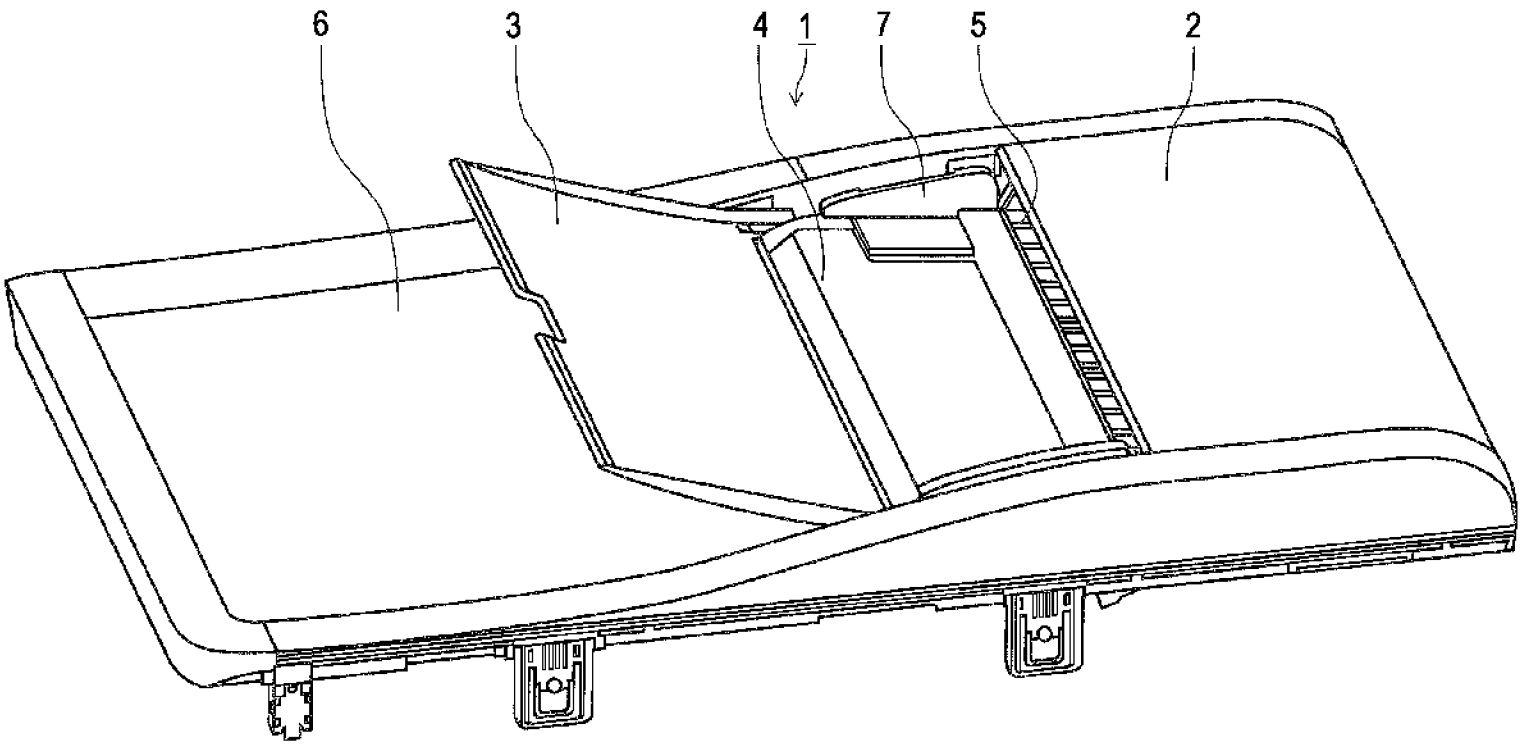
FIG. 1 is a perspective view of an automatic document transportation device according to the invention.
Figure 2:
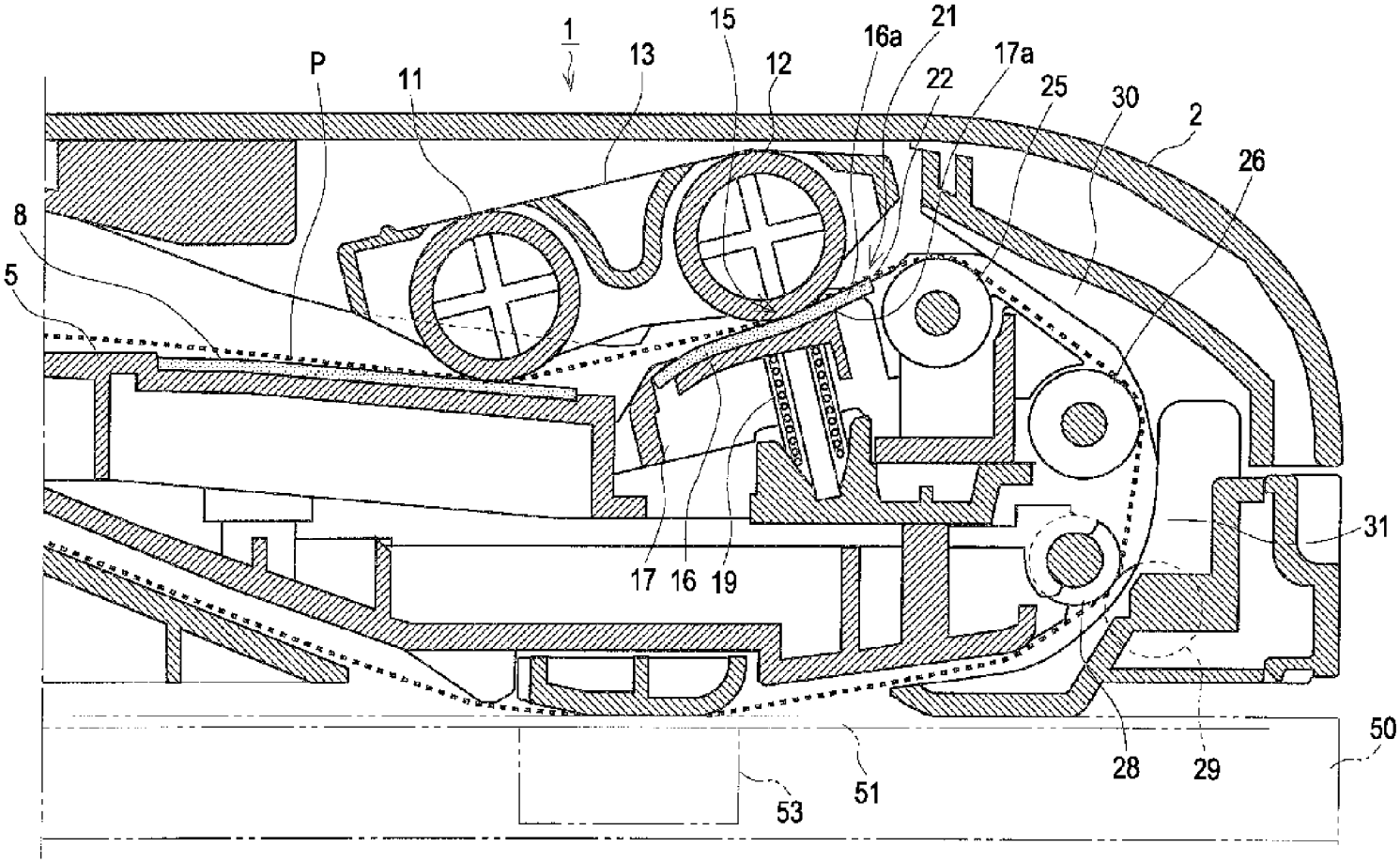
FIG. 2 is a side sectional view of the automatic document transportation device according to the invention.
Figure 3:
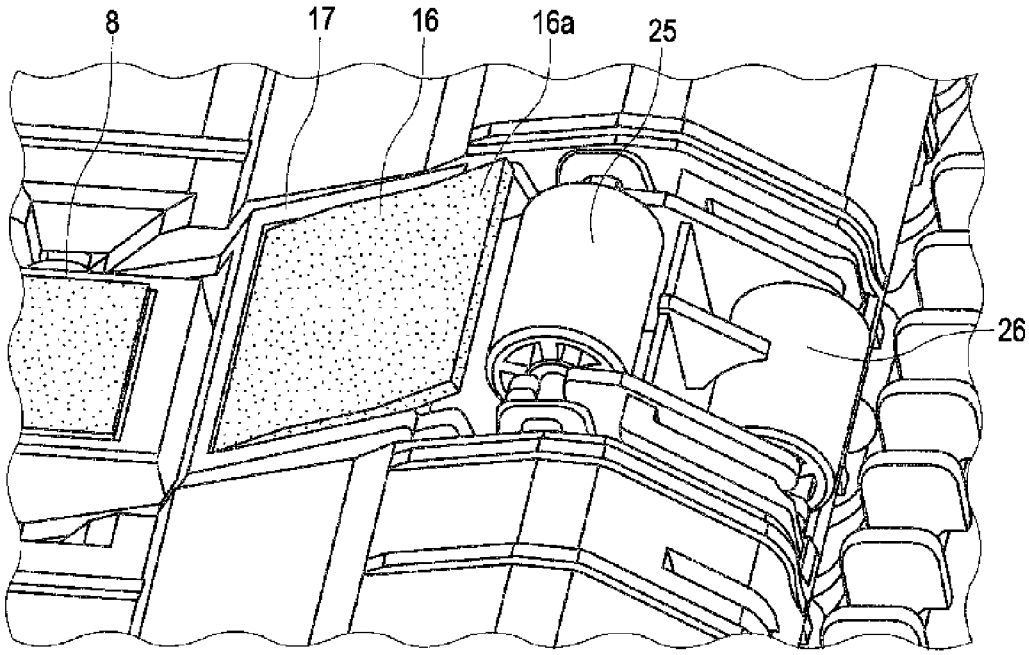
FIG. 3 is a perspective view of an area on which a friction separation member is mounted.
Figure 4:
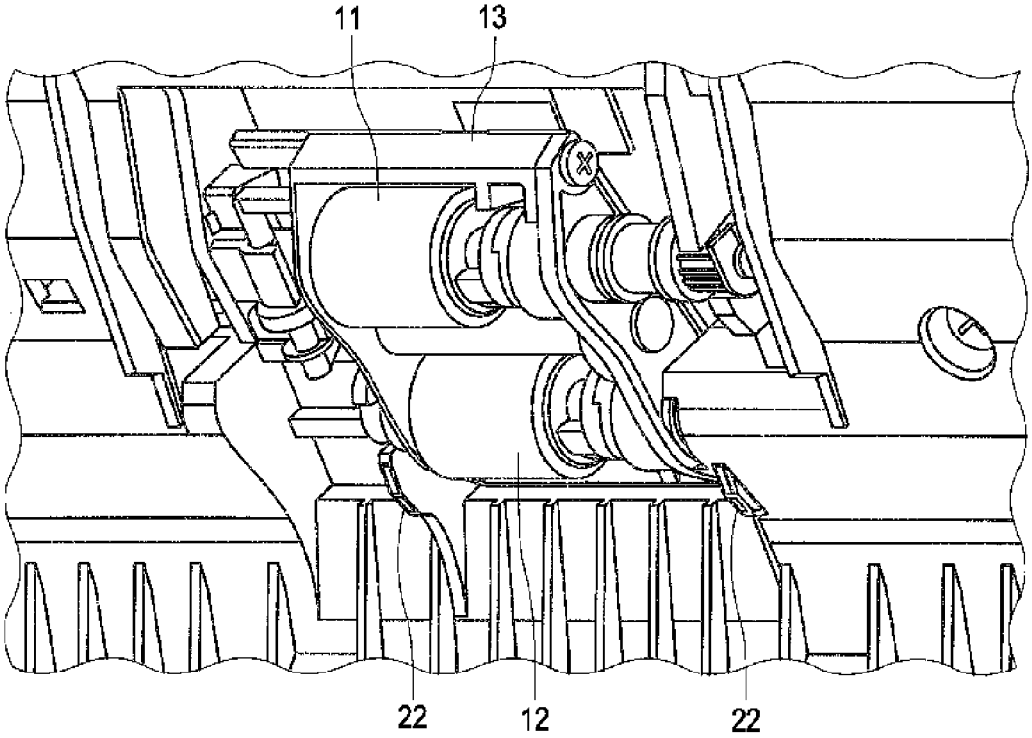
FIG. 4 is a perspective view of an area on which a feed roller and a separation roller are mounted.
Figure 5:
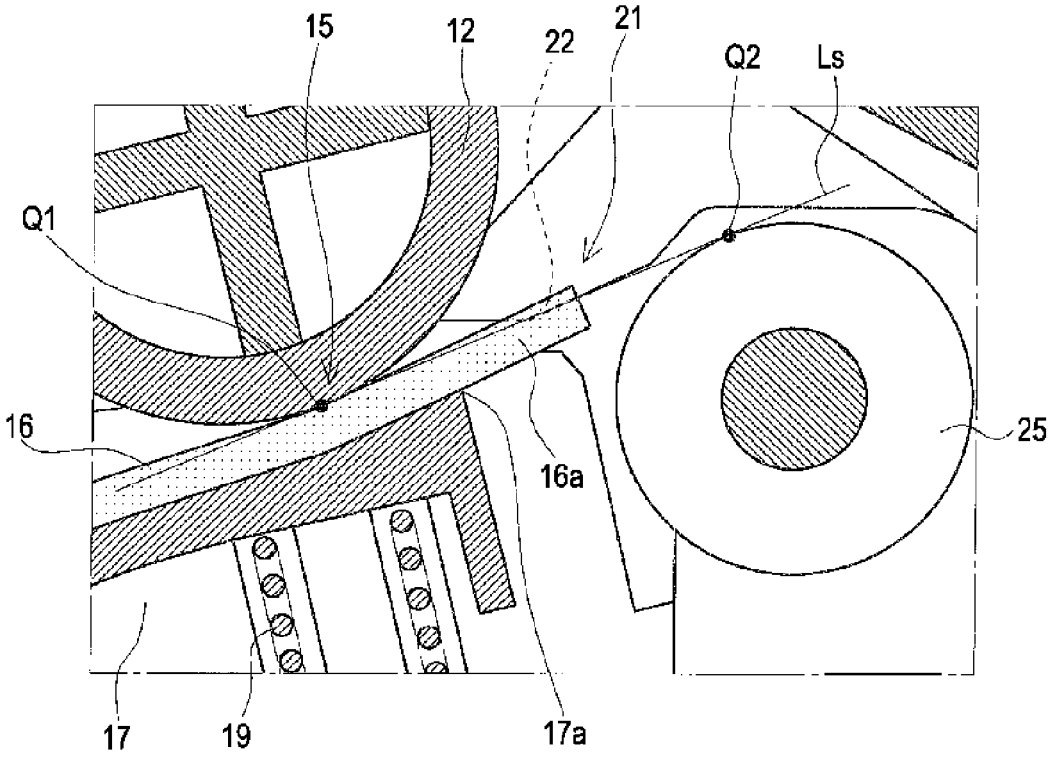
FIG. 5 is an enlarged view around the friction separation member of FIG. 2.
Figure 6:
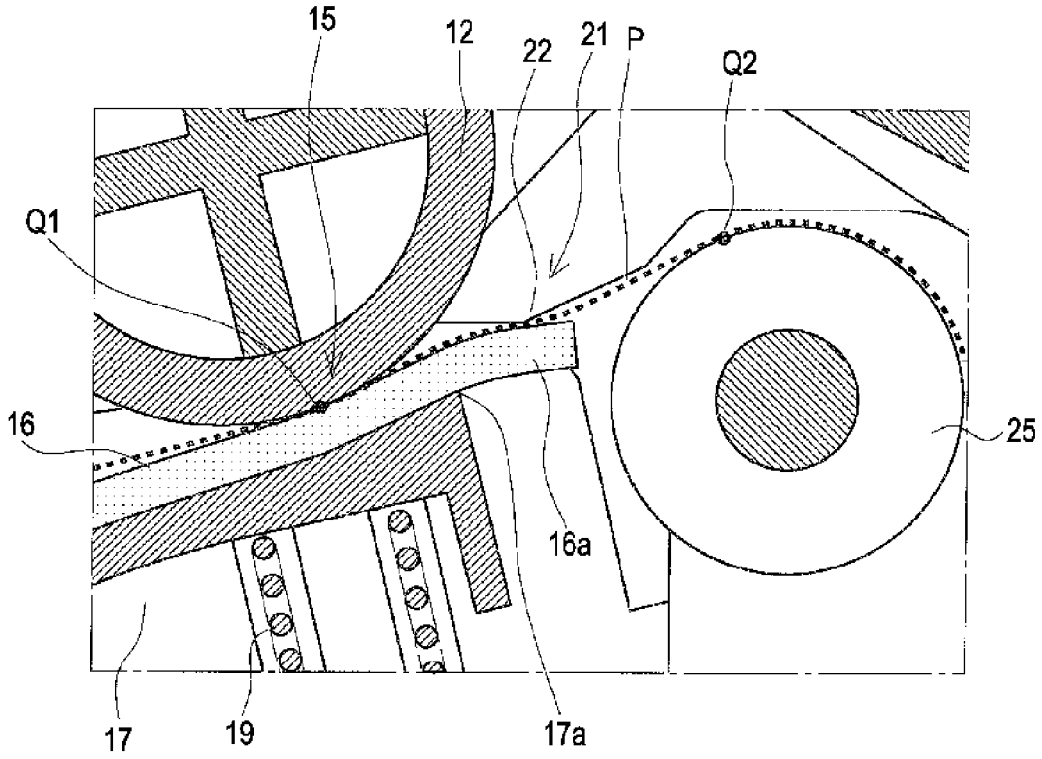
FIG. 6 is an enlarged view around the friction separation member of FIG. 2.

FIG. 1 is a perspective view of an automatic document transportation device (auto document feeder (ADF)) 1 as an embodiment of a medium feeding device according to the invention. FIG. 2 is a (partial) side sectional view of the automatic document transportation device 1. FIG. 3 is a perspective view of an area on which a friction separation member 16 is mounted. FIG. 4 is a perspective view of an area on which a feed roller 11 and a separation roller 12 are mounted. FIGS. 5 and 6 are enlarged views around the friction separation member 16 of FIG. 2 (FIG. 5 shows a sheet passing state, and FIG. 6 shows a non-sheet passing state).

Figure 7:
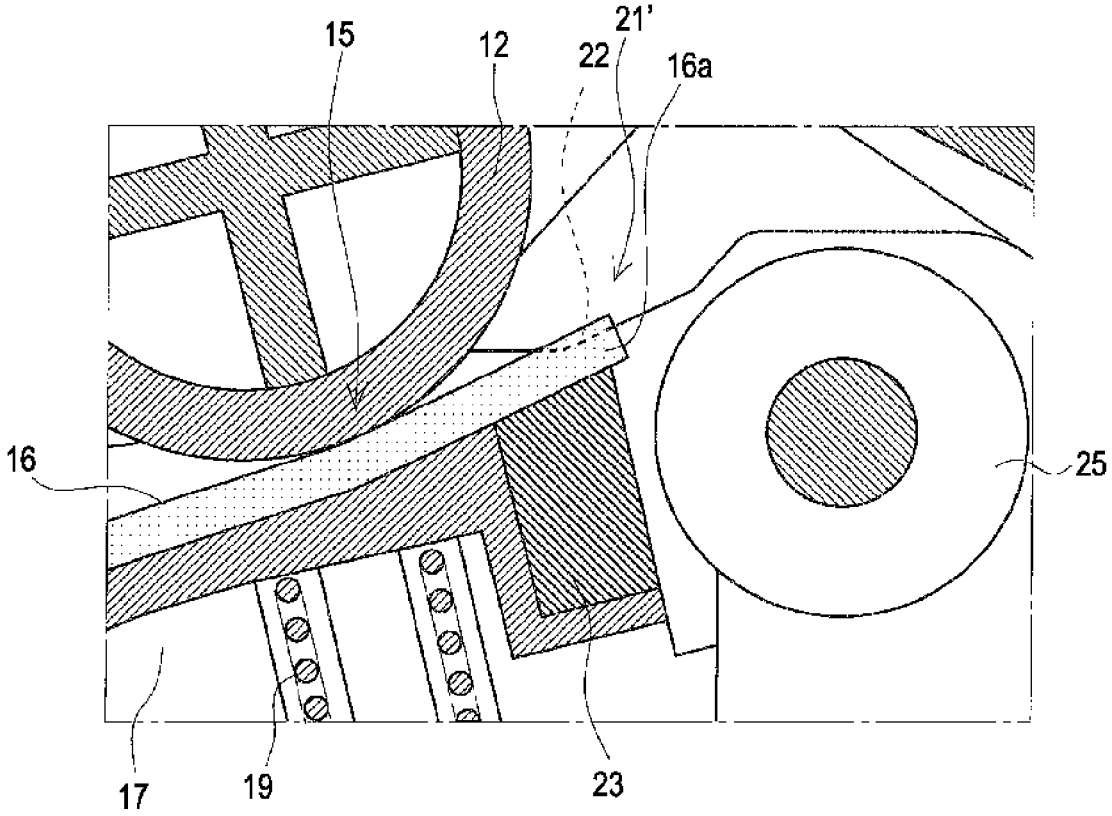
FIG. 7 is a view which shows another embodiment of the area on which the friction separation member is mounted.
Figure 8:
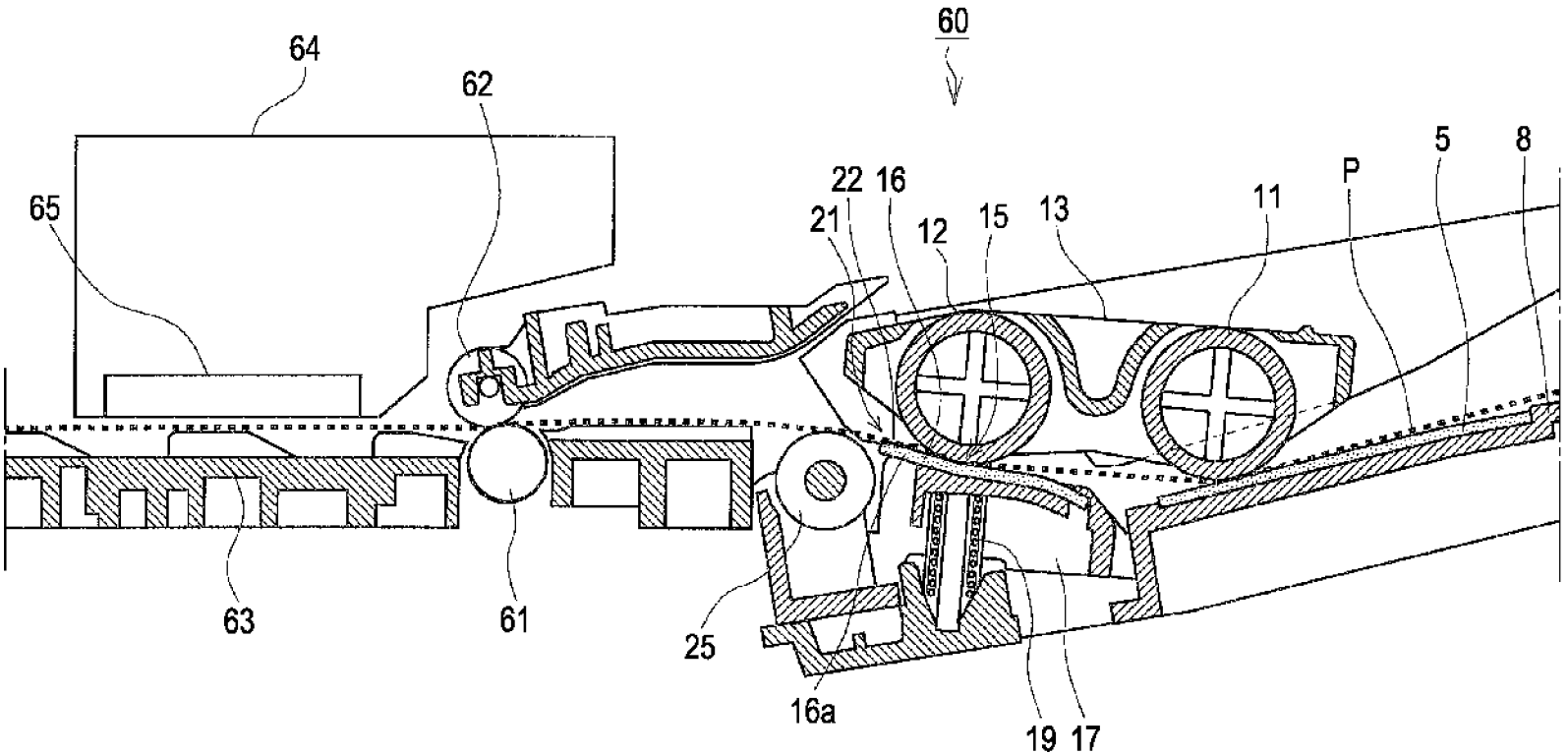
FIG. 8 is a side sectional view of a recording apparatus when the invention is applied to the recording apparatus.

Further, FIGS. 7 and 8 show another embodiment of the invention. FIG. 7 is a view which shows another embodiment of the area on which the friction separation member 16 is mounted. FIG. 8 is a (partial) side sectional view of a recording apparatus 60 when the invention is applied to the recording apparatus 60. The term "upstream" as used herein refers to being located in the upstream area in a document transportation (feed) path (an area opposite to the area toward which the document is directed), and the term "downstream" as used herein refers to being located in a downstream area in the document transportation (feed) path (the area toward which the document is directed).

The external configuration of the automatic document transportation device 1 and a configuration of the medium transportation path (feed path) will be briefly described below. The automatic document transportation device 1 is detachably mounted on the uppermost position of an ink jet printer, which is not generally shown in the figure. Reference numeral 50 in FIG. 2 denotes a scanner unit mounted on a recording execution unit (not shown in the figure) that performs recording on a medium, and the automatic document transportation device 1 is mounted above the scanner unit 50.

As shown in FIG. 1, the automatic document transportation device 1 includes a first upper cover 2 and a second upper cover 3 which form the appearance of the upper portion of the automatic document transportation device 1. The second upper cover 3 is openable and configured to assume an inclined position when opened so as to support the medium (document) to be read, as shown in FIG. 1. Further, the first upper cover 2 is also openable and configured, when opened, to expose the document feed path in the automatic document transportation device 1 to the outside so as to remove problems such as paper jam.

Reference numeral 4 and reference numeral 5 denote an upstream support member and a downstream support member, respectively. The document to be read is supported by the second upper cover 3, the upstream support member 4 and the downstream support member 5. Further, reference numeral 7 denotes an edge guide that regulates the side edge of the document. Reference numeral 6 denotes an output sheet receiving unit. Once the document is read, the document is output and supported on the output sheet receiving unit 6.

Next, the configuration of the medium transportation path along which the document as a medium is transported in the automatic document transportation device 1 will be described with reference to FIG. 2. In FIG. 2, reference character P (broken line) denotes a route through which the document is transported in the automatic document transportation device 1.

A holding pad 8 is disposed at a position on the leading edge of the downstream support member 5 so as to have a high friction coefficient relative to the document. Further, a feed roller 11 which is driven by a motor (not shown in the figure) is arranged opposite the holding pad 8 so as to come into contact with and move away from the document placed in a set position.

When the feed roller 11 rotates while being in contact with the top sheet of the documents placed in the set position, the top sheet of the documents is fed downstream. That is, the feed roller 11 serves as a medium feeding unit that feeds out the document from the set position. The holding pad 8 is made of, for example, rubber, elastomer, and cork.

A first separation unit 15 is disposed at a position downstream of the feed roller 11. The first separation unit 15 is composed of a separation roller 12 which is driven by a motor (not shown in the figure) to rotate in the forward direction and the friction separation member 16 which is formed as a pad and cooperates with the separation roller 12 so as to nip the document therebetween. In the first separation unit 15, the document to be fed is nipped between the separation roller 12 and the friction separation member 16 and separated from the subsequent sheets of paper so as to prevent the subsequent sheets of paper from being fed with the document to be fed. The friction separation member 16 is also made of, for example, rubber, elastomer, and cork. The separation roller 12 is configured to come into contact with the topside of the document, while the friction separation member 16 is configured to come into contact with the underside of the document, thereby performing separation function.

In this embodiment, the friction separation member 16 that constitutes the first separation unit 15 further extends downstream such that a second separation unit 21, which will be described later in detail, is formed by feed path restriction members 22 and the friction separation member 16. According to this embodiment, the positions of the feed roller 11, the separation roller 12 and the friction separation member 16 in the document width direction (the direction perpendicular to the drawing sheet of FIG. 1) are consistent.

Driven rollers 25 and 26 are disposed at positions downstream of the second separation unit 21 and are capable of being driven to rotate. Further, a transport driving roller 28 which is driven by a motor (not shown in the figure) and a transport driven roller 29 which is driven to rotate to cooperate with the transport driving roller 28 so as to nip the document therebetween are disposed at positions downstream of the driven rollers 25 and 26.

The driven rollers 25 and 26, the transport driving roller 28, and guide members 30 and 31 that are arranged opposite the above-mentioned rollers form a curved turn-around path along which the document is turned around. The document passes through the curved turn-around path and then reaches the upper surface of a document bed glass 51 that constitutes the scanner unit 50.

Reference numeral 53 denotes a sensor carriage having a reading sensor as a reading unit. As the document is transported while the sensor carriage 53 rests in a stationary position, the reading of the document is performed. After the reading of the document is performed, the document is output to the output sheet receiving unit 6 of FIG. 1 by an output roller which is not shown in the drawing.

The configuration of the automatic document transportation device 1 has been briefly described above. In the following description, the detail of the second separation unit 21 will be provided.

The second separation unit 21 is composed of the above-mentioned friction separation member 16 and the feed path restriction members 22. FIG. 3 is a view showing a state in which the friction separation member 16 is mounted. The friction separation member 16 is supported (fixedly secured) by the support member 17 as shown in FIG. 3. More specifically, the friction separation member 16 is supported such that a predetermined amount thereof extends downstream from a downstream end 17*a* (FIG. 5) of the support member 17 so as to form a non-supported area 16*a* that is not supported by the support member 17.

The support member 17 is movable toward or away from the separation roller 12. The friction separation member 16 is biased so as to be in press contact with the separation roller 12 by a coil spring 19.

Each of the feed path restriction members 22 is disposed on each side of the feed roller 11 and the separation roller 12 as shown in FIG. 4. Further, each of the feed path restriction members 22 is also located on each side of the friction separation member 16. That is, the feed path restriction members 22 are arranged such that the friction separation member 16 is located therebetween. Reference numeral 13 denotes a pivotally movable member that supports the feed roller 11 and the separation roller 12. The pivotally movable member 13 is configured to pivotally move about the rotation center of the separation roller 12 and, when the pivotally movable member 13 pivotally moves, the feed roller 11 moves toward or away from the document placed in the set position.

Moreover, the feed path restriction members 22 are formed to project with respect to the document feed path so as to overlap the friction separation member 16 as seen in the side view of the document feed path. That is, the contact portion of the feed path restriction members 22 which comes into contact with the topside of the document is located at a position lower than the upper surface of the friction separation member 16. Accordingly, in the second separation unit 21, the feed path is in a state that seems to be closed by the friction separation member 16 and the feed path restriction members 22.

As mentioned above, the second separation unit 21 is composed of the friction separation member 16 and the feed path restriction members 22 that cooperate with the friction separation member 16 to close the feed path as seen in the side view of the feed path and the feed path at the position of the second separation unit 21 seems to be closed as seen in the side view of the feed path. As a consequence, the leading edge of the document is ensured contact with the friction separation member 16 even if the leading edge of the document is curled in either the up or down direction, thereby preventing double-feed of the media with certainty.

Although the feed path at the position of the second separation unit 21 seems to be closed as seen in the side view of the feed path, the document to be fed can pass through the second separation unit 21 when the document or the friction separation member 16 is deformed. It should be noted that, although the friction separation member 16 and the feed path restriction member 22 in this embodiment are overlapped such that the feed path seems to be closed as seen in the side view of the feed path, the friction separation member 16 and the feed path restriction member 22 are not necessarily overlapped and, for example, the friction separation member 16 and the feed path restriction member 22 may be in a state being in contact with each other as seen in the side view of the feed path (not overlapped with each other).

Further, in this embodiment, the friction separation member 16 is positioned such that the document to be fed is in close contact with the friction separation member 16 when a tension is applied to the document by pulling the document from a position downstream of the second separation unit 21. Accordingly, when a tension is applied to the document by the downstream rollers nipping the leading edge of the document (in this embodiment, the transport driving roller 28 and the transport driven roller 29), the effect of the second separation unit 21 to prevent double-feed of the documents is not compromised and the documents can be prevented from being double-fed with certainty.

Moreover, in this embodiment, the driven roller 26 that controls the deformation amount of the friction separation member 16 is provided downstream of the second separation unit 21. In FIG. 5, reference character Ls denotes a common tangent line of the separation roller 12 and the driven roller 25 as seen in the side view of the document feed path, while reference characters Q1 and Q2 denote points where the tangent line Ls is tangent to the separation roller 12 and the driven roller 25, respectively. The point Q1 also indicates a point where the separation roller 12 and the friction separation member 16 are in contact with each other.

In this embodiment, the friction separation member 16 upwardly extend (into the document feed path) from the tangent line Ls by a predetermined amount. When the document is pulled by a force exerted from a downstream position as indicated by the broken line P in FIG. 6, the friction separation member 16 is also pulled downward. At this time, the upper surface of the friction separation member 16 does not comes to a position at least lower than the tangent line Ls due to the driven roller 25, that is, the feed path remains to be closed by the friction separation member 16 and the feed path restriction members 22, thereby maintaining the effect of the second separation unit 21 to prevent double-feed of the documents as appropriate. Although the feed path restriction member 22 of this embodiment extends into the feed path so as to be located at substantially the same position as the tangent line Ls, the feed path restriction member 22 may be formed to extend further lower than the tangent line Ls.

When the friction separation member 16 is pulled downward, the amount that the friction separation member 16 is displaced downward varies depending on the resiliency of the sheet. For example, when the sheet that passes through the second separation unit 21 has a high resiliency, the friction separation member 16 may be pulled downward to the extent that friction separation member 16 and the feed path restriction member 22 are not overlapped as seen in the side view of the feed path, since the sheet is not easily flexed. Alternatively, when the sheet that passes through the second separation unit 21 has a low resiliency, the friction separation member 16 and the feed path restriction member 22 may remain to be overlapped even if the friction separation member 16 is pulled downward to a certain extent, since the sheet is easily flexed.

In addition, the friction separation member 16 of this embodiment is formed to extend upstream such that the friction separation member 16 also constitutes the first separation unit 15. Accordingly, the friction separation member 16 is common to the first separation unit 15 and the second separation unit 21, thereby reducing cost of the medium feeding device.

Further, in this embodiment, the downstream portion of the friction separation member 16 is formed as the non-supported area 16*a* that is not supported by the support member 17, and the feed path is closed by the non-supported area 16*a* and the feed path restriction members 22 as seen in the side view of the feed path. Accordingly, the friction separation member 16 is relatively easily flexed when the document passes through the second separation unit 21, thereby avoiding generation of an excessive load when the document passes through the second separation unit 21.

The above-mentioned embodiment is exemplary and it is obvious that the invention is not limited thereto. For example, as shown in FIG. 7, the second separation unit 21' may be configured such that the non-supported area 16*a* of the friction separation member 16 is supported by an elastic member 23 that is elastically deformable.

With this configuration, it is possible to maintain the property of the non-supported area 16*a* to be relatively easily deformable while preventing the non-supported area 16*a* from being plastically deformed and the separation function is irreversibly deteriorated. Further, it is also possible to prevent the non-supported area 16*a* of the friction separation member 16 from being excessively flexed, thereby preventing the closed state of the feed path from being easily removed. The elastic member 23 may be formed of sponge, elastomer and the like.

Although the medium feeding device according to the invention is applied to the scanner unit 50 which is an example of image reader in this embodiment, the medium feeding device may be applied to a sheet feed path in the recording apparatus that performs recording to a recording medium.

Such embodiment is shown in FIG. 8 in which reference numeral 60 denotes a recording apparatus. In FIG. 8, the same reference numeral refers to the same configuration of the above-mentioned embodiment. The configuration downstream of the driven roller 25 in the embodiment of FIG. 8 differs from that of the above-mentioned embodiment.

In an area downstream of the driven roller 26, there are disposed an ink jet recording head 65, a carriage 64 having the ink jet recording head 65, a sheet support member 63 that is positioned opposite the ink jet recording head 65, and a transport driving roller 61 and a transport driven roller 62 that cooperate to feed the sheet into a position between the ink jet recording head 65 and the sheet support member 63. In the recording apparatus 60 having the above-mentioned configuration, it is also possible to prevent double-feed of the sheets by the second separation unit 21 even if the leading edge of the sheet is curled in the similar manner to the above-mentioned automatic document transportation device 1.

The entire disclosure of Japanese Patent Application No. 2011-109081, filed May 16, 2011 is expressly incorporated by reference herein.

What is claimed is:

1. A medium feeding device comprising:

a medium feeding unit that feeds a medium placed in a set position;

a friction separation member that is disposed downstream of the medium feeding unit and is configured to come into contact with an underside of the medium, the friction separation member being deformable, the friction separation member including an end portion that is not supported by a support member that supports the friction separation member, the end portion extending out from an edge of the support member that is a most downstream edge, the friction separation member having a first separation unit facing a first downstream driven roller; and a plurality of feed path restriction members that are arranged such that the feed path restriction members are disposed on each side of the medium feeding unit and are disposed on each side of the friction separation member, a contact portion of the feed path restriction members which comes into contact with a topside of the medium being located at a position lower than an upper surface of the friction separation member, wherein a tangent line between the first separation unit and the first downstream driven roller has a first point Q1 being at a location where the tangent line is tangent to the first separation unit and where the medium contacts the first separation unit and a second point Q2 being at a location where the tangent line is tangent to the first downstream driven roller, the end portion of the friction separation member that is not supported extending above the tangent line by a predetermined amount, wherein when the end portion of the friction separation member that is not supported is pulled downward due to a force exerted from downstream in a feed path, an upper surface of the end portion that is not supported does not go below the tangent line.

2. The medium feeding device according to claim 1, further comprising a separation roller that is configured to come into contact with the topside of the medium.

3. The medium feeding device according to claim 2, further comprising the support member that supports the friction separation member, wherein a downstream end of the friction separation member extends from the support member.

4. The medium feeding device according to claim 3, wherein the support member is movable toward or away from the separation roller and is biased to the separation roller.

5. A scanner comprising:

a reading unit that reads a surface of a medium; and the medium feeding device according to claim 1 that feeds the medium to a reading position where the media is read by the reading unit.

6. A recording apparatus comprising:

a recording unit that performs recording to a medium; and the scanner according to claim 5 that is mounted on the upper portion of the recording unit.

7. A medium feeding device comprising:

a medium feeding unit that feeds a medium placed in a set position;

a first separation unit that is disposed downstream of the medium feeding unit and separates the medium that is to be fed from a subsequent media; and a second separation unit that is disposed downstream of the first separation unit and separates the medium that is to be fed from the subsequent media, wherein the second separation unit is composed of a friction separation member and feed path restriction members that cooperate with the friction separation member to close a feed path of the medium as seen in a side view of the feed path, the friction separation member including an end portion that is not supported by a support member that supports the friction separation member, the end portion extending out from an edge of the support member that is a most downstream edge and is on the second separation unit side of the support member, wherein the feed path restriction members are disposed on each side of the medium feeding unit and each side of the friction separation member, wherein a contact portion of the feed path restriction members that comes into contact with a topside of the medium is located at a position that is lower than an upper surface of the friction separation member, wherein a tangent line between the first separation unit and a first downstream driven roller has a first point Q1 being at a location where the tangent line is tangent to the first separation unit and where the medium contacts the first separation unit and a second point Q2 being at a location where the tangent line is tangent to the first downstream driven roller, the end portion of the friction separation member that is not supported extending above the tangent line by a predetermined amount, wherein when the end portion of the friction separation member that is not supported is pulled downward due to a force exerted from downstream in the feed path, an upper surface of the end portion that is not supported does not go below the tangent line.

* * * * *